US009333558B2

(12) United States Patent
Darling et al.

(10) Patent No.: US 9,333,558 B2
(45) Date of Patent: May 10, 2016

(54) BINARY OR HIGHER ORDER HIGH-DENSITY THERMODYNAMICALLY STABLE NANOSTRUCTURED COPPER-BASED TANTALUM METALLIC SYSTEMS, AND METHODS OF MAKING THE SAME

(71) Applicant: U.S. Army Research Laboratory ATTN: RDRL-LOC-I, Adelphi, MD (US)

(72) Inventors: Kristopher A. Darling, Havre de Grace, MD (US); Laszlo J. Kecskes, Havre de Grace, MD (US); Brady G. Butler, Havre de Grace, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 424 days.

(21) Appl. No.: 13/779,803

(22) Filed: Feb. 28, 2013

(65) Prior Publication Data

US 2015/0375301 A1 Dec. 31, 2015

Related U.S. Application Data

(60) Provisional application No. 61/604,924, filed on Feb. 29, 2012.

(51) Int. Cl.
*B22F 9/04* (2006.01)
*C22C 9/00* (2006.01)
(Continued)

(52) U.S. Cl.
CPC ..... *B22F 9/04* (2013.01); *B02C 17/1815* (2013.01); *B02C 17/20* (2013.01); *B02C 23/06* (2013.01); *C22C 9/00* (2013.01); *F42B 1/032* (2013.01);
(Continued)

(58) Field of Classification Search
None
See application file for complete search history.

(56) References Cited

U.S. PATENT DOCUMENTS

| | | | | |
|---|---|---|---|---|
| 6,732,914 | B2 * | 5/2004 | Cadden et al. | 228/250 |
| 2005/0092400 | A1 | 5/2005 | Botcharova et al. | |
| 2012/0024109 | A1 * | 2/2012 | Xu et al. | 75/243 |

OTHER PUBLICATIONS

R.J. Comstock, Jr. and T.H. Courtney, "Elevated-Temperature Stability of Mechanically Alloyed Cu—Nb Powders," Metallurgical and Material Transactions A, vol. 25A, Oct. 1994, 2091-2099.
(Continued)

*Primary Examiner* — George Wyszomierski
(74) *Attorney, Agent, or Firm* — Christos S. Kyriakou; Eric B. Compton

(57) ABSTRACT

A binary or higher order high-density thermodynamically stable nanostructured copper-tantalum based metallic system according to embodiments of the invention may be formed of: a solvent of copper (Cu) metal that comprises 70 to 100 atomic percent (at. %) of the metallic system; and a solute of tantalum (Ta) metal dispersed in the solvent metal, that comprises 0.01 to 15 at. % of the metallic system. The metallic system is thermally stable, with the absence of substantial gross grain growth, such that the internal grain size of the solvent metal is substantially suppressed to no more than about 250 nm at approximately 98% of the melting point temperature of the solvent metal and the solute metal remains substantially uniformly dispersed in the solvent metal at that temperature. Processes for forming these metallic systems may include: subjecting powder metals of solvent and the solute to a high-energy milling process using a high-energy milling device to impart high impact energies to its contents. Due to their high-density thermodynamically stable nanostructured, these metallic systems are an ideal candidate for fabricating shaped charge liners for ordinance.

15 Claims, 3 Drawing Sheets

(51) Int. Cl.

| | |
|---|---|
| ***F42B 1/032*** | (2006.01) |
| ***B02C 17/20*** | (2006.01) |
| ***B02C 17/18*** | (2006.01) |
| ***B02C 23/06*** | (2006.01) |

(52) U.S. Cl.
CPC ..... *B22F 2009/043* (2013.01); *B22F 2009/049* (2013.01)

(56) References Cited

OTHER PUBLICATIONS

J. Xu et al., "Effect of Milling Temperature on Mechanical Alloying in the Immiscible Cu—Ta System," Metallurgical and Material Transactions A, vol. 28A, Jul. 1997, 1569-1580.

D.L. Zhang, "Processing of advanced materials using high-energy mechanical milling," Progress in Materials Science 49 (2004) 537-560.

E. Ma, "Alloys created between immiscible elements," Progress in Materials Science 50 (2005) 413-509.

T. Venugopal et al., "Mechanical and Electrical Propertiers of Cu—Ta Nanocomposites Prepared by High-Enery Ball Milling," Acta Materialia, vol. 55 (2007), 4439-4445.

I. Budai and G. Kaptay, "A New Class of Engineering Materials: Particle-Stabilized Metallic Emulsions and Monotectic Alloys," Metallurgical and Material Transactions A, vol. 40A, Jul. 2009, 1524-1528.

T. Frolov and Y. Mishin, "Stable Nanocolloidal Structures in Metallic Systems," Physical Review Letters 104, 055701 (2010).

M. Atwater et al., "The Thermal Stability of Nanocrystalline Copper Cryogenically Milled with Tungsten," Materials Science and Engineering A, vol. 558 (2012), 226-233.

M. Atwater and K.A. Darling, "A Visual Library of Stability in Binary Metallic Systems: The Stabilization of Nanocrystallline Grain Size by Solute Addition: Part 1," US Army Research Laboratory, Aberdeen Proving Ground, MD 20005, ARL-TR-6007, May 2012.

T. Frolov et al., "Stabilization and strengthening of nanocrystalline copper by alloying with tantalum," Acta Materialia 60 (2012) 2158-2168.

Copper Presentation entitled: "Grain Size Stabiization in Nanostructured Copper Alloys." given at: The Minerals, Metals & Materials Society (TMS) 2011 Annual Conference, San Diego, CA, Mar. 1, 2011.

D.G. Morris and M.A. Morris, "Mechanical Alloying of Copper—BCC Element Mixtures," Scripta Metallurgica et Materialia, vol. 24, pp. 1701-1706, 1990.

J. Freudenberger et al., "Formation of the microstructure in Cu—Nb alloys," Journal of Materials Science 39 (2004) 5343-5345.

E. Botcharova et al., "Supersaturated solid solution of niobium in copper by mechanical alloying," Journal of Alloys and Compounds 351 (2003) 119-125.

E. Botcharova et al., "Mechanical and electrical properties of mechanically alloyed nanocrystalline Cu—Nb alloys," Acta Materialia 54 (2006) 3333-3341.

E. Botcharova et al. "Mechanical alloying of copper with niobium and molybdenum," Journal of Materials Science 39 (2004) 5287-5290.

E. Botcharova et al. "Cu—Nb alloys prepared by mechanical alloying and subsequent heat treatment," Journal of Alloys and Compounds 365 (2004) 157-163.

J. M. Rigsbee, "Development of Nanocrystalline Copper-Refractory Metal Alloys," Materials Science Forum vols. 561-565 (2007) pp. 2373-2378.

W.P. Walters and J.A. Zukas, Fundamentals of Shaped Charges, John Wiley & Sons, Inc.: New York (1989), pp. 72-96.

Conference Presentation entitled: "Large Scale Powder Processing of High Strength Copper Alloys." given at The Minerals, Metals & Materials Society (TMS) 2012 Annual Conference, Orlando FL, Mar. 11-15, 2012.

Kris Darling, Suveen Mathaudhu and Laszlo Kecskes, "Demonstration of Ultrahigh-Strength Nanocrystalline Copper Alloys for Military Applications," Project Number: WP-2139, Strategic Environmental Research and Development Program (SERDP) (Report is dated "Jan. 22, 2012"; however, this report was not actually submitted to SERDP until Jun. 1, 2012, and it is believed to have first become available to the public on Sep. 6, 2012).

* cited by examiner

BINARY OR HIGHER ORDER HIGH-DENSITY THERMODYNAMICALLY STABLE NANOSTRUCTURED COPPER-BASED TANTALUM METALLIC SYSTEMS, AND METHODS OF MAKING THE SAME

CROSS REFERENCE TO RELATED APPLICATION(S)

This application claims the benefit of U.S. Provisional Patent Application No. 61/604,924 filed Feb. 29, 2012, incorporated by reference in its entirety herein.

GOVERNMENT INTEREST

The invention described herein may be manufactured, used, and licensed by or for the United States Government without the payment of royalties thereon.

BACKGROUND

1. Field of the Invention

The present disclosure relates to binary or higher order high-density thermodynamically stable nanostructured metallic copper-based metallic systems, such as copper-tantalum (Cu-Ta) metallic systems, and methods of making the same.

2. Description of the Related Art

Bulk nanocrystalline metals, alloys, and composites have recently generated great interest and attention in the scientific community. This is mainly due to the exotic mechanical properties with which they are associated. Recent reports indicate that ultra-high strength and moderate ductility are possible in such metals. The combined possibility of ultra-high strength and ductility (i.e., ultra-tough nanocrystalline materials) make nanocrystalline metals and alloys the future of advanced metallurgy.

However, a major drawback to commercialization of these unique materials is the inability to mass produce large quantities of bulk material. Currently, commercialized products have been limited to electrolytic coatings and/or steels where the spacing of the microstructual phases is on the nanometer scale.

There are primarily two main methodologies for fabricating and producing nanocrystalline alloys. The two approaches available are a top-down approach and a bottom-up approach. In the top down processing approach, one takes a bulk piece of metal or alloy and through subjecting it to severe plastic deformation, the internal coarse grain size (tens of micrometers) of the bulk object is reduced to the nanoscale.

Top-down methods include equal channel angular extrusion (ECAE) or pressing, high pressure torsion (HPT), surface mechanical attrition treatment (SMAT), etc. Some of the top-down approaches suffer from limitations in the size and geometry of the materials which could be produced. For instance, in ECAE, the forces required to extrude a large billet are determined by its cross-sectional dimensions and could be exceedingly high if a large extrudate is desired. Additionally, due to the nature of the extrusion process, the fully deformed or worked region, especially during multi-pass extrusions, can be quite limited. Similarly, in HPT, because of the necessary pressures and confinement required, only relatively small 10- to 20-millimeter diameter by a few millimeters thick specimens can be fabricated. Likewise, in SMAT coatings, only the top few hundreds of micrometers beneath the exterior surface becomes deformation-processed having a nanostructure.

In contrast, the bottom-up approach entails the use of methods in which metallic particulates are produced. Typically, the particles have an average diameter of 10 nm to tens of millimeters. However, it is important to recognize that the larger particles still maintain an interior nanostructure despite their seemingly large size. There are multiple bottom up approaches including mechanical milling/alloying which could be used to produce a range of metallic particulates. Such bottom up processes used to produce nanostructured and nanocrystalline metals can be scaled-up readily to produce large quantities of powder.

Particulate (powdered) materials offer greater versatility when considering up-scaling to production and manufacturing levels. In part, this is because powder metallurgy is already a long term and existing practice being used to produce many commercially available products through sintering and forging of metallic particles into fully dense objects. Sintering is a method which allows for the production of near-net-shape, ready-to-use parts having almost unlimited dimensional restrictions while reducing the cost of post-production machining. While sintering functions to consolidate the loose particulates into a coherent solid, fully dense body, post-sinter forging is designed to impart the densified part with further increases in properties such as strength, ductility, etc.

Generally, in fine particulate materials, especially those with nano- to submicrometer size, there is an extremely large driving force to reduce the relative ratio of surface to volume area or surface to volume energy. This driving force is thermally activated and, therefore, occurs more efficiently at higher temperatures. The movement of particle boundaries, causes fine particles coalesce, merge, and grow into larger particles. If the temperature is near or in excess of 50% of the melting point of the material, this process is referred to as sintering. In addition to heat, if pressure could be applied to improve the sintering process, more rapid densification would occur, eliminating voids between the particles. If diffusion distances could be kept at a minimum, uninterrupted species transport could then be allowed. While some of the coarsening can be controlled by careful adjustment and selection of sintering conditions (i.e., an optimization and manipulation of the three dimensional processing surface of time, temperature, and pressure), the coarsening is unavoidable.

It should be clear that by nature, nanocrystalline or nanostructured powders tend to be metastable; that is, thermodynamically they are not in their lowest energy or the ground state, but instead, are in an elevated or higher energy state. As such, when favorable conditions arise, and energy may be released, thereby returning the material into its ground state, they coarsen to micrometer- or larger scale rapidly, even below conventional sintering temperatures. Thus, the coarsening or grain growth process with the concomitant reduction of the surface area to volume ratio returns the material to a lower energy state. Obviously, an associated effect of the coarsening process is the loss of the nano-grain size or nanostructure and the corresponding advantageous physical properties of the precursor powders. Therefore, while the powder metallurgically fabricated part is superior to conventionally produced equivalents, major improvements could still realized if the nanostructure could be retained in the product.

Schemes for preventing grain growth in nanocrystalline metals have been based on determining the velocity of grain boundaries undergoing curvature driven growth, which is the product of two terms: the mobility and the pressure of the grain boundaries. Therefore, two general approaches, namely, addressing each of these terms, independently, have been used to reduce grain growth in nanocrystalline metals. In the first, methods focus to modify the kinetics of grain growth by reducing the grain boundary mobility. In the second, methods are designed to modify the thermodynamics by reducing the driving force through attenuation of the grain boundary excess free energy which, in turn, decreases the driving pressure. Previous literature known to the inventors has shown both methods to be successful in preventing grain growth in some nanocrystalline systems. However, neither of these methodologies have been shown to be successful in the copper-tantalum (Cu-Ta) system. Specifically, the literature only speaks to the general aspects of thermodynamic stability; but, it does not speak directly to identifying the underlying and controlling thermodynamics involved in how to predict greater stability in Cu-Ta or other specific systems.

SUMMARY OF THE INVENTION

Various binary and higher order high-density thermodynamically stable nanostructured copper-tantalum metallic systems, and method of making the same, are presented herein according to embodiments of the invention.

According to various embodiments, a binary or higher order high-density thermodynamically stable nanostructured copper-tantalum metallic system may include: a solvent of copper (Cu) metal that comprises 70 to 100 atomic percent (at. %) of the metallic system; and a solute of tantalum (Ta) metal dispersed in the solvent metal, that comprises 0.01 to 15 at. % of the metallic system, wherein the metallic system is thermally stable, with the absence of substantial gross grain growth, such that the internal grain size of the solvent metal is substantially suppressed to no more than about 250 nm at approximately 98% of the melting point temperature of the solvent metal and the solute metal remains substantially uniformly dispersed in the solvent metal at that temperature.

In the various embodiments of the metallic systems, the solvent metal may have an un-heat treated grain size less than about 100 nm, and the solute metal may have an un-heat treated grain size less than about 250 nm. Moreover, the metallic system may be substantially free of un-favorable interstitial and or substitutional contaminants. In some embodiments, the metallic system may have a composition of Cu-10 at. % Ta.

These embodiments thus provide a new class of high-density nanostructured and nanocrystalline metallic alloys or composites which have stable properties up to and nearing the melting point. For instance, an average dispersed Ta particle and internal grain size may be less than about 200 and 250 nm, respectively, at or below about 1040° C. And, more particularly an average dispersed Ta particle and internal grain size may be both less than about 50 nm at or below 1040° C. Moreover, the metallic system may have a Vickers microhardness of about 3.00 GPA, more preferably, 4.75 GPa, or more at room temperature, and advantageously capable of retaining a Vickers microhardness of about 2 GPa or more at temperatures in excess of about 98% of the melting point of the solvent metal.

According to further embodiments, a process for forming a binary or higher order high density thermodynamically stable nanostructured Cu-Ta metallic system comprised of a solvent of Cu metal comprising 70 to 100 atomic percent (at. %) of the metallic system, and a solute of Ta metal dispersed in the solvent metal, comprising 0.01 to 15 at. % of the metallic system, the process may include: subjecting powder metals of the solvent metal and the solute metal to a high-energy milling process using a high-energy milling device configured to impart high impact energies to its contents, wherein the metallic system is thermally stabilized, with the absence of substantial gross grain growth, such that the internal grain size of the solvent metal is substantially suppressed to no more than about 250 nm at approximately 98% of the melting point temperature of the solvent metal and the solute metal remains substantially uniformly dispersed in the solvent metal at that temperature.

During high-energy milling, the high-energy milling device may utilize a mixing vial for containing the metallic powder, and a plurality of milling balls for inclusion within the mixing vial for milling the metallic powder therein. The ball-to-powder mass ratio utilized by the high-energy milling device may be 10:1 or more. Furthermore, the milling balls may be comprised only of stainless steel. During the high-energy milling process, the metallic powder may be cooled to a cryogenic temperature. This may be accomplished by cooling the milling device with liquid nitrogen. Alternatively, the high-energy milling process may be performed at ambient or room temperature. The high-energy milling process may be further improved using an additive or a surfactant. In some instances, the metallic powder may be continuously or semi-continuously cooled during the high-energy milling process. In further embodiments, at the conclusion of the milling process, the metallic powder may be subjected to annealing by exposing it to elevated temperature in the range of about 300 to 800° C.

These embodiments thus provide a methodology for forming a new class of binary of higher order high-density nanostructured and nanocrystalline metallic alloys or composites which are thermodynamically stable at high temperatures required for consolidation, wherein grain growth can be controlled and largely suppressed.

These properties make them an ideal candidate for forming shaped charge liners in ordinance. Thus, according to yet another embodiment, a shaped charge liner for ordinance may be fabricated from a binary or higher order high density thermodynamically stable nanostructured Cu-Ta metallic system.

These and other, further embodiments of the invention are described in more detail, below.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments, including less effective but also less expensive embodiments which for some applications may be preferred when funds are limited. These embodiments are intended to be included within the following description and protected by the accompanying claims.

FIG. 1 shows x-ray diffraction patterns of as-milled Cu-10 at. % Ta showing the presence of the Ta phase, and the diffraction pattern is given in.

DETAILED DESCRIPTION OF INVENTION

Figure 1:
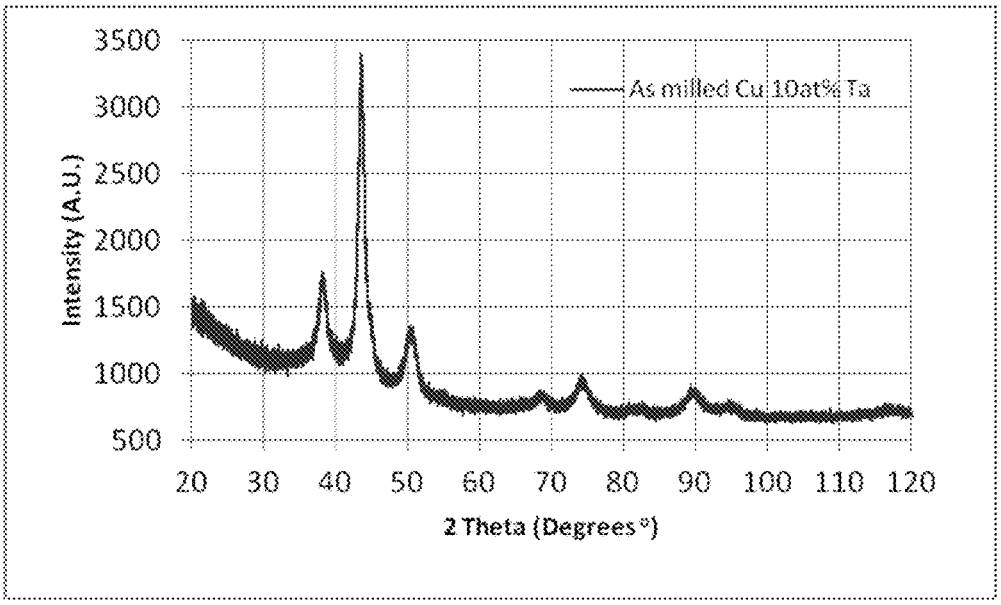

Binary or higher order high-density thermally stable nanocrystalline Cu-Ta metallic systems composed of two (in the case of a binary system) or more (in the case of a higher order system) constituent metals.

For instance, binary or higher order high-density thermodynamically stable nanostructured Cu-Ta metallic system according to embodiments of the invention may be formed of: at least a solvent of Cu metal that comprises 70 to 100 atomic percent (at. %) of the metallic system; and a solute of Ta metal dispersed in the solvent metal, that comprises 0.01 to 15 at. % of the metallic system,. The metallic system is thermally stable, with the absence of substantial gross grain growth, such that the internal grain size of the solvent metal is substantially suppressed to no more than about 250 nm at approximately 98% of the melting point temperature of the solvent metal and the solute metal remains substantially uniformly dispersed in the solvent metal at that temperature.

While the terms alloy and composite may be used interchangeably herein in describing certain metallic systems in some instances, they are different in some regards. In one sense, because certain metals (such as Cu and Ta) may be ordinarily immiscible in a solution, they may be described as a composite. That is, unlike an alloy, there is no true or real intermixing on an atomic level that could lead to a permanent structure. Typically, in an alloy, the constituents are so well mixed together that they are inseparable.

Processes for forming the binary or higher order high-density thermodynamically stable nanostructured Cu-Ta metallic system may include: subjecting powder metals of the solvent metal and the solute metal to a high-energy milling process using a high-energy milling device configured to impart high impact energies to its contents, wherein the metallic system is thermally stabilized, with the absence of substantial gross grain growth, such that the internal grain size of the solvent metal is substantially suppressed to no more than about 250 nm at approximately 98% of the melting point temperature of the solvent metal and the solute metal remains substantially uniformly dispersed in the solvent metal at that temperature. For instance, a high-energy milling device may be used to subject the metallic powders to the high-energy milling process. Such a device may include: a mixing vial for containing the metallic powders and a plurality of milling balls for inclusion within the mixing vial for milling the metallic powders therein.

High-energy milling is a term of art, which denotes powdered milling processes that facilitate alloying on an atomic level. As such, they utilize significantly higher impact energies than other powdered milling processes, such as planetary milling or attritor milling, wherein, due to the physical design of the apparatus, the energy imparted to the powder is less. Examples of high-energy milling apparatuses include the SPEX Industries, Edison, N.J. series of mills. Lower energy types include the Pulverisette planetary ball mills from Fritsch GmbH, Idar-Oberstein, Germany; the PM series of planetary ball mills from Retsch GmbH, Dusseldorf, Germany; or the attritor type mills from Union Process, Akron, Ohio.

Depending on the extent of high-energy milling operations, the range of intermixing varies from particles (on the order of micro- to millimeters, containing a very large number atoms), to precipitates (nano- to micrometers, containing thousands of atoms), to clusters (nanometers, containing tens of atoms), to single atoms. High energy may be imparted to the metallic system by applying high levels of kinetic or dynamic energy during the milling process.

The diameter, density, mass, number and/or ratio of the milling media may be altered to maintain the ball to powder mass (weight) ratio sufficiently high so as influence the rate of breakdown, physical microstructure and morphology of the resultant powder produced. For instance, the ball-to-powder mass ratio may be 10:1 or more.

More specifically, embodiments of the present disclosure may relate to nanostructured copper-tantalum (Cu-Ta) alloys or composites, in which the microstructure is stable to temperatures nearing the alloy's or composite's respective melting point. In this binary or two-component system, Cu may be used as the solvent, with Ta being used in the complementary role of solute. One or more other solute metals may be used in addition to Ta in some embodiments.

The exemplary solvent-solute system is composed of a plurality of ultrafine Cu grains stabilized by segregated Ta solute atoms, ranging in size from atomic- to nano-scale clusters to sub-micrometer particles, mostly found in the grain boundary regions between the Cu grains. In some embodiments, the Cu-based Ta alloy may satisfy the general formula ($Cu_{100-x}$-$Ta_x$), where x is between about 0.01 and 15 at. %. Tantalum is a rare element, and its short supply and abundant use in electronics capacitors industry for consumer electronics, makes the metal very costly. Thus, increased percentage of Ta may only drive up the cost.

More specifically, as an example, an exemplary nanocrystalline Cu-10 at. % Ta alloy, which resists grain growth up to 98.3% of the alloy's melting point is disclosed. Due to the aforementioned thermodynamic principles and the intrinsic nature of the binary Cu-Ta system, high-energy mechanical alloying results in a nanostructured composite. These composite structures can maintain an average Cu matrix grain size of less than 250 nm and a dispersed Ta phase less than 250 nm in diameter up to 1040° C. or 98.3% of the alloy's melting temperature. The melting point temperature of metallic Cu is approximately 1080° C.

When a metallurgically modified material's grain structure has been highly deformed and consequently refined, it has been displaced from its lowest stable energy state. As such, there is a tendency to return it to its most stable state. This is most easily facilitated by the application of heat. The onset temperature for the existing deformed grains to be consumed and grow into grains, usually initiates well below the melting point of the material. This temperature is generally referred to as the grain growth temperature. For most metal systems, the grain growth temperature is usually about 0.3-0.4 times the melting point temperature. However, for some metals, grain growth can occur at room temperature. Because with decreasing grain size, there is a greater tendency to move to a more stable state, the grain growth temperature tends to be lower. This is why it is quite remarkable if nanostructured material could retain its nano-scale structure up to and beyond this temperature.

By using a thermodynamic mode of stabilization, whether alone or in addition to a kinetic mode of stabilization, it is possible to create thermodynamically stable nanocrystalline alloys which are highly resistant to internal grain growth at high homologous temperatures nearing the alloy's or composite's respective melting point. Thermodynamically stabilized nanostructured metallic alloys may be formed of a solvent metal, and a solute metal dispersed in the solvent metal.

There are many key aspects of this invention. One aspect is the recognition and need to simultaneously track a set of unique and characteristic material properties, and their behavior with temperature and concentration. It is noted that other factors, such as pressure, and other thermodynamic state variables, can generally be neglected. Another aspect is the ability to use predictive analytical and/or empirical equations to predict such trends.

Grain boundary segregation is a highly complex phenomenon, wherein modeling may not completely predict and emulate a real system. Therefore, certain trade-offs are believed to be necessary to attain the desired predictability to guide current experimentation. However, it is the convergence of specific inherent attributes of the Cu-Ta system that facilitates the physical properties of the embodiments, described herein possible. These characteristic attributes for the system are: a generic tendency to be immiscible, grain boundary energy reduction upon segregation, exhibit a chemical enthalpy of mixing, solvent-solute interaction, elastic enthalpy, configurational entropy, inter- and intra-granular bond energy reduction, and temperature and grain size effect. There are other lesser physical parameters, as well. However, the four key parameters that in essence determine if a system will be thermodynamically stable are: (i) the elastic enthalpy, (ii) the mixing enthalpy, (iii) the normalized grain boundary energy, and (iv) the solute concentration. All should be optimized relative to one another; each, in turn needs to attain a specific value to result in a stable system. Specifically, the elastic enthalpy needs to be large to drive the segregation, the enthalpy of mixing needs to be near zero to minimize phase separation or intermetallic formation, the normalized grain boundary energy should also be zero for complete stabilization, and there is a percentage of the solute that will minimize the overall energy of the system, whether it is zero or not.

The Cu-Ta metallic system, for example, has a low positive enthalpy of mixing, equal to 2 kJ/mol for an equimolar mixture in the liquid state. However, the enthalpy of mixing is both compositionally and temperature dependent, and, most likely, remains positive between 0 and 20 kJ/mol. This particular metallic system also has a large elastic enthalpy, estimated to be −44 kJ/mol at room temperature. Both of these factors work in unison to impart the system with an ability to force solid solubility. Additionally, the slow diffusion rates of Ta atoms along Cu grain boundaries facilitates slow separation of the two species, where these diffusion rates are orders of magnitudes lower than the self-diffusion rate of the solvent species. For the Cu-Ta system, this stability can occur over a wide specific compositional range from 0.01 to 15 at. % Ta. However, if any of these parameters or attributes are altered, then the physical properties may be altered, and correspondingly an unstable system may result.

Similar to documented examples in the prior art, the inventors have also contemplated the use of Nb as a kinetic stabilizer to Cu. Many of the relevant physical properties of the two elements are similar and published results do show that mechanically alloyed Cu-Nb has good to excellent microhardness and electrical resistivity values. However, associated with the less refractory nature of Nb, these alloys are not as stable at temperatures near the melting point of Cu. Specifically, compared to Ta with a melting point of 3017° C., Nb has a lower melting point of 2477° C. Mo also has a lower melting point of 2623° C. This difference translates into rapid grain growth and, correspondingly, a significant degradation of thermal stability above 900° C. for the latter systems. In fact, at 1000° C., while for Cu-Ta, the solvent grain size is between 100-200 nm, for Cu-Nb, the solvent grain size is between 400-500 nm.

In some embodiments, Cu-Ta based alloys and composites having a Vickers microhardness value of up to 5 GPa at around room temperature (typically defined as being approximately 20° C. plus/minus a few degrees), which is double that reported for similar, but non-grain-size stabilized alloys at around the same temperature. Additionally, it has been shown that these alloys and composites can retain greater than 2 GPa Vickers microhardness after having been annealed at 1040° C. or 98.3% of the alloy's melting temperature for 4 hours or more. For comparison sake, the highest strength nanocrystalline Cu has a room temperature Vickers microhardness of approximately 2.3 GPa and undergoes extensive grain growth at room temperature.

The exemplary metallic powders, due to their high thermal stability, may be formed into a bulk solid under high temperatures and pressures while retaining a nanocrystalline microstructure and properties comparable to high strength alloyed steels. By virtue of their thermal stability, the alloyed composites easily lend themselves to both non-conventional and conventional consolidation methods. Whereas, conventional methods include pressure-less sintering, hot isostatic pressing, and hot pressing, non-conventional methods include field assisted sintering techniques, dynamic compaction using explosives or forging-like operations, high pressure torsion and extrusion methodologies including hot extrusion, warm, or cold extrusion, as well as equal channel angular extrusion.

Embodiments of the present invention may be incorporated into or used to modify as-processed isotropic micro- and nano-structure of the alloy and/or composite. Specifically, by employing special extrusion and consolidation methods, the initially isotropic microstructure could be further processed to yield a textured or gradient structure, thereby imparting it with location- or spatially specific and/or directional properties. In particular, a spatially or compositionally gradient structure may be realized by the blending of powders with varying properties. That is, in one case, different Cu to Ta ratios may be used to prepare the blends, which are then pressed into a solid body according to a prescribed distribution to enhance or retard a specific property. In another case, Cu-Ta blends, mechanically alloyed for different lengths of time, to impart them with varying grain size, then can be combined to results in a particle size gradient in the bulk. For instance, for increased electrical conductivity, one section of the specimen could be Cu-rich while the other one is not. Alternatively, a textured microstructure can be realized if the initially isotropic specimen is rolled or extruded (e.g., equal channel angular extrusion). Depending on the extent of reduction in cross-sectional area, an acicular or laminar microstructure could be easily attained.

The commercialization of high strength Cu alloys which can retain their nanocrystalline microstructure and advanced mechanical properties are of interest. Materials with high strength and good conductivity are important and may be used in sliding electrical contacts, resistance welding electrodes, high field magnet coils, explosively formed penetrators, and x-ray tube components.

1. Kinetic Modes of Stability

In general terms, kinetic stability can be understood as follows. Any given state of a system can be stabilized kinetically. For example, in a system, where the inherent microstructure is influenced or kinetically stabilized by some physical parameter, phenomenon, or combination of phenomena thereof, will have a reduced rate at which the system reaches the equilibrium or low energy state. That is, kinetic stabilization affects and reduces the rate how fast the system moves from the unstable to stable state. Of course, the effectiveness of the stabilization is strongly dependent on the magnitude of the driving force and the inherent activation energy of the retarding physical phenomena.

Specific to the exemplary embodiments described herein, several methods are available for applying retarding forces to grain boundaries, whereby their mobility and, thus, the kinetics of grain growth is reduced. One important example may be Zener pinning where second phase particles are dispersed in the metal. For a long time, it has been known that secondary phases will impede the movement of grain boundaries, interfaces, or dislocations. It may be noted that Zener pinning can be more effective in immiscible systems, wherein the solute species is insoluble in the solvent. Thus, if solute can be effectively dispersed it will remain inert in the solvent. A measure of the effectiveness of the reduced grain boundary mobility can be expressed in terms of the Zener pinning pressure. This pressure is greatest when the pinning phase is small (e.g., less than 100 nm) and occurs at high volume fractions.

For instance, in the art known to the inventors, milling techniques by themselves have been employed to impart Cu with some better and improved properties (e.g., finer grain size, greater strength, lower electrical resistivity, etc. at low temperatures). But none of their teachings are believed to demonstrate an understanding of the fundamentals and exploitation of the alternative thermodynamically-based stabilization of the Cu-Ta system to temperatures near the melting point of the system.

Cu-Ta composite alloys have been previously produced by mechanical alloying in various ball mill types, most typically planetary (e.g., PM400 Retsch or Fritsch Pulverisette-5) or high energy shaker mill. One such, high energy shaker mill is the SPEX 8000D shaker mill from SPEX Industries of Edison, N.J. Usually, the precursor powders are loaded into a vial with sufficient milling media to ensure adequate pulverization and reduction in particle size. Under the action of the mill, the milling media impact repeatedly on the powder charge. This milling results in a macroscopic average particle size for the Cu and Ta of about few micro- to submillimeters.

However, due to the impact energies involved, it is important to recognize that within each of these particles, the internal mixing scale is reduced much finer, more particularly, down to the nanoscale. Previously-produced blends may result in similar particle sizes. However, it is believed by the inventors, that, in the absence of the high impact energies, it is unlikely that any atomic level mixing has occurred.

To avoid cold welding and sticking to the vial and milling media (usually made from iron-based or ceramic materials), the mechanical alloying process could be carried out at liquid nitrogen temperatures and/or with a surfactant. Thus, whereas such mechanical alloying methodologies have been well documented, the inventors are aware of no prior mention or recognition of an energy minimization based approach which results in a far greater level of stability in the system. The present invention attempts to delineate these facts from the teachings of the prior art.

Furthermore, the majority of the prior work performed on mechanically alloyed Cu-Ta composite alloys has dealt with alloys in which Ta is the major constituent. These studies focused on the solid-state amorphization and the stability of such structures. Alternatively, there have been a few reports on the Cu-rich sides of the equilibrium phase diagram. In those reports, mechanical alloying was used to only ascertain if meta-stable solid solutions could be produced at various milling temperatures and times. Long term stability, especially at elevated temperatures, is believed to have been overlooked. Herein, the inventors define metastable as a description of the behavior of certain physical systems that can exist in long-lived states that are less stable than the system's most stable energetically favored state.

To the inventors' knowledge, they are aware of only one published manuscript on the mechanical properties and grain growth of Cu-Ta composite alloys with Ta as the minor constituent. See T. Venugopal et al., "Mechanical and Electrical Propertiers of Cu-Ta Nanocomposites Prepared by High-Enery Ball Milling," Acta Materialia, Vol.55 (2007), 4439-4445, herein incorporated by reference in its entirely (hereinafter "Venugopal et al."). These alloys were milled at room temperature using a Fritsch Pulverisette-5 planetary ball mill with tungsten carbide (WC) as the milling media and toluene as a process control agent. Due to the typically lower energies imparted to the particulates in a planetary mill, the starting as-milled Cu grain size for the 30 wt. % (13.0 at. %) Ta sample, after 20 hours of milling, was approximately 40 nm. As a result, the peak Vickers microhardness given in this study is 2.381 GPa at room temperature. Vickers microhardness values were 1.400 GPa at 5 wt. % (1.8 at. %), 1.613 GPa at 10 wt. % (3.7 at. %), and 2.348 GPa at 25% (10.5 at. %), respectively. This is approximately half of the value of the metallic systems invented and described herein. The lack of greater hardness is believed to be attributed to the inability to disperse the solute effectively in the solvent, most likely due to the use of and reliance on a low energy milling apparatus.

2. Thermodynamic Modes of Stability

It is important for the purposes of the invention described herein that the difference between the two forms of stabilization is understood. The thermodynamic state of any system is defined by state variables, such as, for example, internal energy, enthalpy (or heat content), entropy, pressure, volume, temperature. In contrast, the kinetic mode of stability defines the specific route that the system traverses, moving from one state to another.

More specifically, thermodynamic stability is defined and differentiated from kinetic stability as follows. A given state in a polycrystalline system, where the inherent microstructure based on the thermodynamic state variables attains a prescribed, equilibrium state (e.g., a certain grain size associated with an energy level), wherein further movement to another energy level is only attained by modifying the total energy of the system. In terms of grain growth, this is only possible if the driving force for growth, and subsequent microstructural coarsening, has been attenuated or completely removed by a manipulation of the thermodynamic state variables.

The thermodynamic driving force for grain growth is known to be proportional to the energy associated with the grain boundaries, therefore; reducing this energy should have a large effect on reducing grain growth. Furthermore, it has been routinely demonstrated that segregated impurity atoms have an effect of reducing grain boundary energy. Literature has also shown that by proper selection of the impurity atom, the 'grain boundary excess' of that atom will increase resulting in an associated decrease in the grain boundary energy. Such systems have shown a profound increase in the thermal stability and, therefore, a retention of nano-scale substructures at high homologous temperatures (the homologous temperature is defined as the actual temperature normalized to the melting point [absolute units]). For example, the effectiveness of thermodynamic stabilization with increasing temperature is illustrated in the current embodiment of Cu-Ta versus attempts to repeat the same in Cu-W, and documented by M. Atwater et al., "The Thermal Stability of Nanocrystalline Copper Cryogenically Milled with Tungsten," Materials Science and Engineering A, Vol.558 (2012), 226-233, herein incorporated by reference in its entirely, wherein that system becomes unstable at around 700° C. Whereas above this temperature, the Cu-Ta embodiment retains its nanostructure, stability in Cu-W is no longer sustainable. In other words, Cu-W is not thermodynamically stable.

In grain boundary segregating systems, by using a modified equation based on a nearest-neighbor regular solution model to predict solute atoms segregation to free surfaces, it is possible to select alloy systems for which the reduction in grain boundary energy is large. The detailed computational aspects of this technique has been documented in M. Atwater and K. A. Darling, "A Visual Library of Stability in Binary Metallic Systems: The Stabilization of Nanocrystallline Grain Size by Solute Addition: Part 1," US Army Research Laboratory, Aberdeen Proving Ground, MD 20005, ARL-TR-6007, May 2012, herein incorporated by reference in its entirety.

Briefly, this technique is possible by considering a series of system properties, such as the free surface energies of the respective elements in their native environments, respective valence structures, crystal structures, and mutual solubilities, enthalpy of mixing, elastic strain enthalpy, electronegativity difference, and charge transfer between the species. Aside from the concentration of the solute, there are believed to be three other major factors which contribute to, and promote grain boundary segregation of solutes. Two of these are chemical in nature and include the difference in grain boundary free surface energy between the solvent and solute and the enthalpy of mixing of the two species. The third, the elastic enthalpy or strain energy, is the degree of elastic misfit which arises from the formation of a solid solution between two differently sized atoms. Segregation, and therefore grain boundary energy reduction will be greatest when the free surface energy is lower for the solute than for the solvent, when the enthalpy of mixing is positive and the elastic strain energy is large. The other factors such as the electronegativity difference, charge transfer, valence, crystal structure and solubility limits are indicators of the overall cohesiveness of the grain boundaries and bulk solute concentration required to maintain the smallest possible equilibrium grain size in the segregated state. Systems that exhibit good mechanical properties are highly resistant to grain growth are selected by noting the large propensity for solutes to segregate to grain boundaries and in which the cohesiveness of the grain boundaries is increased by the presence of the solute.

A major difference in the milling process being disclosed and the reported prior methods is the recognition of the fact and exploitation that for complete and uniform distribution and dispersion of the solute in the solvent much higher impact energies are required. Completely uniform distribution and dispersion means that some portion of the Ta or other solute species has been driven into the solvent forming a random solid solution with the Cu or solvent species, with the remainder of Ta solute being dispersed in the form of atomic clusters or larger particulates having dimensions in the lower nano limit of about 1-10 nm. Note, this is significantly less than the dimension of the grain size of the solvent, which is less than about 250 nm.

Venugopal et al., looked at the systematic reduction of grain size and corresponding increase in microhardness of the Cu-Ta system as a function increasing Ta content, varying from 5 to 30 wt. % (1.8 to 13 at. %) Ta. Aside a demonstration from a monotonic decrease of the grain size, the inventors believe that the teachings of Venugopal et al., exclude the possibility of the formation of solid solutions between Cu and Ta, thereby essentially ignoring the basis for any thermodynamic stabilization in this system.

Similarly, J. Xu et al., "Effect of Milling Temperature on Mechanical Alloying in the Immiscible Cu-Ta System," Metallurgical and Material Transactions A, Volume 28A, July 1997, 1569-1580 (hereinafter "Xu et al."), previously reported effects of milling energy on alloying. But, unlike that of Xu's teaching, the inventors believe that higher milling energy does not necessarily relate to better kinetic stabilization. They believe, more specifically, this milling to relate to kinetic pinning, as this pinning is based on the size and volume fraction of pinning agent; where the equilibrium particle size reached during the milling process may or may not be weakly affected by the imparted milling energy. Moreover, they believe, that in Xu et al., the selection of Ta for Cu is apparently based on their mutual lack of solubility in one another (i.e., immiscibility) to create a series of finely scattered inert dispersoids. However, in contrast, they believe that the thermodynamic stabilization of the present invention takes into consideration exactly they overlooked, the interrelation of the two elements in a thermodynamic context.

The inventors further believe that thermodynamic stabilization has not only not been attained by the prior art, but also, due to certain limitations, could not be attained by the prior art.

The total energy required to properly mechanically alloy is dependent on the judicious selection of the solute and solvent of the system including the respective amounts of each. The amount of energy that can be imparted is also determined by the type of mill being used. Unlike those in a passive rolling mill, vials used in a high energy SPEX mill are shaken back and forth thousands of times a minute using impact milling media resulting in more than twice as many impacts a minute.

When 30 or more ball bearings are used in the vial for milling the powder, this results in millions of impacts per hour with greater pressure (psi) loadings and higher energies than those available in other standard mills. The ball bearings may have a diameter of ¼inch and/or ⅜-inch, for example. The larger ⅜-inch balls have approximately twice the mass of the smaller ¼-inch balls. In some instances, the ratio of the larger to smaller balls may be about 50/50, but other ratios of milling media may be used. For a given mass (weight) of powder metal, the mass (weight) of the impact milling media should be proportionally adjusted to maintain substantially the same high ball-to-powder mass (weight) ratio.

In experiments conducted by the inventors, thirty four (34) stainless steel (440C) ball-bearings, 17 of which having a diameter of ¼inch and the other 17 having a diameter of ⅜inch, were used as the milling media in a 8000D SPEX shaker mill, shaking and milling the powdered metal for 8 or more hours.

In addition, it may be noted that the milling process disclosed here was carried out at liquid nitrogen temperatures. The formation of solid solutions between the constituents could be thought of as a competition between the external force of impinging balls creating finer and finer levels of intermixed alloy material via consolidation, shearing, and plastic deformation and competing processes such as diffusion-driven events such as phase separation. Thus, if mechanical milling could be performed at low enough temperatures interdiffusion events, which are thermally activated, could all together be suppressed. As such, the likelihood of producing a solid solution is greatly enhanced. Given that the effect of the competing process is nullified, the result will be not only a much greater refinement of the grain size but also a much larger increase in the concentration of the solute in the solvent, i.e., though, non-equilibrium, the solubility limit will be higher.

The disclosure herein, relates to Cu-Ta alloys and composites, however, it should be appreciated that, in general, the thermally stabilized methodology is applicable to various Cu-based alloys and composites, more specifically, to an entire family of Cu-based alloys including copper-vanadium (Cu-V), copper-chromium (Cu-Cr), copper-zirconium (Cu- Zr), copper-niobium (Cu-Nb), copper-molybdenum (Cu-Mo), copper-hafnium (Cu-Hf), copper-tungsten (Cu-W) alloys with a large range of alloy compositions. Other Cu-based alloys and composite may also be possible. The stability and overall mechanical, thermal, and electrical properties may vary for both the metallic system and global solute concentration. That is, each binary or higher order metallic system must be examined independently of one another. Moreover, what is characteristic of one system usually cannot be extrapolated to another system.

Nanostructured Cu-Ta alloys and/or composites of the present invention may also compete with the properties of copper-beryllium (Cu-Be) composites and/or alloys, specifically, in properties such as strength, hardness, electrical conductivity and/or thermal conductivity. Advantageously, Cu-Ta alloys and composites are typically less toxic than Cu-Be alloys and composites. Thus, Cu-Ta alloys and composites can be used as substitutes for Cu-Be alloys and composites. It may be noted, the composition itself and the methodology to form this composition, described herein, could be applied to refining and improving current Cu-Be alloys. Indeed, due to the toxicity of Be, the milling of finely divided particulate Be would create major health hazards and require extreme caution and confined operations.

3. High-Density

High-density materials are desirable for many applications. For example, one untapped application of metallic systems disclosed herein is related to their potential replacements for copper-shaped charge liners for ordnance. Copper-shaped charge liners of this type are described, for example, in W. P. Walters and J. A. Zukas, Fundamentals of Shaped Charges, John Wiley & Sons, Inc.: New York (1989), pp. 72-96, herein incorporated by reference. It has been documented that liner performance is driven by two key factors: the ability to plastically deform and high density.

Thus, if a material could be fabricated with an equivalent ductility and a density higher than that of pure copper, it is believed that this combination will translate into a performance improvement of a shaped charge liner. To this end, the inventors considered various binary and higher order thermally stable nanocrystalline metallic systems for shaped charge liners. Cu-Ta metallic systems were identified as a lead candidate, not only because they provide a thermodynamically stabilized system, but because of their higher density. Indeed, they can be fabricated to provide densities of 9.5 $g/cm^3$ or more, which is well-above that of pure metallic copper.

In particular, using the rule of mixtures, the density of Cu-10 at. % Ta is 10.074 $g/cm^3$. In contrast, densities of Cu-10 at. % V is 8.629 $g/cm^3$, Cu-10 at. % Cr is 8.780 $g/cm^3$, Cu-10 at. % Zr is 8.514 $g/cm^3$, Cu-10 at. % Nb is 8.903 $g/cm^3$, Cu-10 at. % Mo is 9.122 $g/cm^3$, Cu-10 at. % Hf is 9.687 $g/cm^3$, and Cu-10 at. % W is 10.303 $g/cm^3$. It is quite apparent that compared to other options, the use of Ta gives a good density benefit, and improvement over comparable atomic masses of the other solute metals.

Aside from Cu-Ta alloys and composites, even if they could provide a thermodynamically stabilized system, of these potential copper-based combinations listed, only Cu-Mo, Cu-Hf, or Cu-W would result in a considerable increase of the density over that of pure metallic Cu, 8.96 $g/cm^3$. The Cu-Hf system, however, is not fully immiscible, and forms unwanted solid solutions and intermetallic compounds, making it generally not suitably ductile for fabricating for shaped charge liners. Likewise, the Cu-Mo and Cu-W systems have also been found to be unsuitable to this end.

4. Experimental Details/Results of Embodiments of the Present Invention

The same experimental methods may be used to induce both kinetic and thermodynamic stabilization by dispersing one species in another. What differentiates one stabilization method from the other is how and to what extent the solute species is dispersed in the form of particulates or solute atoms. More specifically, the kinetic mode (e.g., Zener pinning) uses particles, whereas the thermodynamic mode uses atoms for the stabilization process.

The traditional definition of an atom is the smallest subdivision in which a particular element still retains its unique characteristics and can be distinguished accordingly from another element. In contrast, particles may consist of individual grains or subgrains, which, in turn, could be made up of hundreds of atoms up to billions of atoms. The stabilization process, either kinetic or thermodynamic, entails emplacing the solute species, ranging in size from atoms to grains to particles, and inserting them into the sub-structure of the solvent. In a liquid, the solute and solvent species are randomly distributed, however, in the solid state, the solute can be emplaced at the atomic level directly into the crystal lattice of the solvent, and/or along grain or subgrain boundaries between crystals of varying sizes. In kinetic stabilization or pinning, the solute species is more of an obstacle preventing the free movement of grain boundaries, while in thermodynamic stabilization, the role of solute species is to alter the energy landscape to a much greater extent.

Xu et al., for instance, concluded that they were unable to obtain an increase in mutual solid-solubility between Cu and Ta. Apparently, the objective of the work was to determine if Cu and Ta could be mixed well together by milling and to confirm the hypothesis, by expecting in the Cu and Ta peak positions, as revealed by x-ray analysis Although, they indicated a nanoscale grain size after milling for both Cu and Ta, Xu et al. did not use microscopy to verify their results. Their milled powders were characterized by x-ray diffraction. Moreover, the inventors believe that when the anticipated shifts in peak positions were not seen by Xu et al. (indicative of solubility in each component, respectively), the results were apparently misinterpreted and the observed slight increase was dismissed as experimental noise. More importantly, in their discourse, they do not discuss thermal stability or how to attain it by thermodynamic means. By contrast, the inventors found the opposite result with their invention.

In general, mechanical milling/alloying produces nanostructured materials with grain sizes well below 100 nm by repeated mechanical attrition of coarser grained powdered materials. Precursor powders are loaded into a steel vial and hardened steel or ceramic balls are also added. The vial then is sealed and shaken for extended periods of time. For example, the vials may be shaken 1060 times a minute resulting in some 2120 impacts a minute. This high-energy ball milling results in an almost complete breakdown of the initial structure of the particles.

More specifically, on an atomic level, atoms can be forced into a metastable random solid solution or potentially occupy defect sights such a dislocations, triple junctions and grain boundaries. This process is critical for setting up thermodynamic stabilization. The breakdown occurs due to the collisions of the particles with the walls of the vial and the balls. The energy deposited by the impact of the milling balls is sufficient to displace the atoms from their crystallographic positions. On a microscopic level, the particles fracture, aggregate, weld, and re-fracture causing the evolution of a heavily worked substructure in the milled powers.

If more than one powder component is added into the vial, the components will be intimately mixed at an atomic level. As in mechanical alloying, this re-welding and re-fracturing continues until the elemental powders making up the initial charge are blended on the atomic level, such that either a solid solution and/or phase change results. The chemistry of the resulting alloy is comparable to the percentages of the initial elemental powders. With continued milling time, grain size reduction occurs, which eventually saturates at a minimum value that has been shown to scale inversely with melting temperature of the resultant compound. Of course, the process cycle can be interrupted to obtain intermediate grain size refinement of the powder blend and intermixing of its constituents.

An exemplary alloyed Cu-Ta compound was prepared by the inventors by loading high purity, 99.95% and 98.5%, respectively, −325 mesh (approximately 45 micrometer) Cu and Ta powders with the correct weight ratio into a clean hardened steel vial to produce the desired atomic percent alloy. The Ta:Cu ratio here was maintained at 1:9. As such, it was expected that the resultant alloys would have had a similar composition of Cu-10 Ta at. %.

Thirty four (34) stainless steel (440C) ball-bearings, 17 of which having a diameter of ¼ inch and the other 17 having a diameter of ⅜ inch, were used as the milling media in a 8000D SPEX shaker mill. The 5-gram powder mass of copper and tantalum was milled with a 10:1 ball-to-powder mass (weight) ratio. Vials were sealed in (primarily) an Argon atmosphere (i.e., with $O_2$<1 ppm). This milling procedure results in a finely divided powder mass, consisting of particulates ranging from a few micro- to submillimeters. The interior structure of the particles is believed to likely consist of further structural refinement, specifically, grains or subgrains of Cu with individual Ta atoms to clusters of Ta atoms dispersed throughout.

The role of contaminants during the milling process can either have an additive or essentially inconsequential effect. On one hand, the latter case arises when a refractory milling medium is used, e.g., tungsten carbide (WC). The WC will fragment, but due to its chemical stability, it will be mostly unlikely that it will go into solution with the solvent. As such, it will more likely act as a finely dispersed kinetic pinning agent. On the other hand, a metallic milling medium, e.g., iron (Fe), can have beneficial or detrimental additive effects. Occasionally, incorporation of Fe is intentional, however, if not, the Fe contamination from milling in steel vial can be significantly reduced or completely mitigated by pre-coating the vial and milling media with pure Cu or the specified alloy to be milled prior to milling. Note, since WC vials are very brittle, this mitigation technique may not be as effective. Therefore, in general, steel vials are preferred over WC or other hard ceramic type vials and or milling media. Contamination should be maintained well less than 1% of the total mass of the metallic powder, and more preferably less than 0.5%.

During the high-energy milling process, the powder metal may be subjected to very low or a cryogenic temperature to embrittle the constituents. Cryogenic temperature is typically defined as temperature below about −150° C. Liquid nitrogen, for instance, having a temperature as low as −196° C. (77K), may be supplied to provide such cooling. Liquid nitrogen milling was made possible by placing the sealed vial in a thick nylon sleeve modified to allow placement into the high energy mill as well as to allow the in-flow and out-flow of liquid nitrogen. The vial was allowed to cool to liquid nitrogen temperature before starting the mill. Mechanical alloying at liquid nitrogen temperatures in the SPEX shaker mill for approximately 10 hours was performed until a minimization and saturation of the grain size occurred. This was verified using X-ray diffraction measurements. The purpose of using liquid nitrogen was to keep the powder cold such that it remained as brittle as possible, thereby preventing or, more precisely, reducing and minimizing the powder from adhering to the milling media and walls of the vial as well as maximizing the propensity to form saturated solid solutions. After the ball milling procedure was completed, the alloyed Cu-Ta powder was removed from the steel vial in an Ar glove box and stored. Mechanical milling resulted in powders with a particle range of 20-200 μm. Other milling experiments were carried out using surfactants to prevent cold welding to the walls of the vial that yielded similar results to those done using liquid nitrogen.

High energy milling can also be performed at ambient or room temperature by use of surfactants including: steric acid, sodium chloride (NaCl), heptane, dodecane, or any other commonly used additive. Using an additive or a surfactant, during the high-energy milling process helps to retard or accelerate the intermixing process, to render the precursors to breakdown, causing the mechanical alloying and atomic-level intermixing of the constituents. As such, to establish and prove that this methodology was also effective, a separate milling trial was also carried out at room temperature using NaCl as a surfactant to prevent sticking. The resultant powder was similar in quality and ease of removal to the powder produced via cryomilling.

These samples, along with the loose powders, were subsequently annealed in a Netzsch 402E high temperature dilatometer for 4 hours at various temperatures under pure hydrogen ($H_2$) gas. X-ray diffraction of the ball milled and annealed powders and compacts were performed with a PANalytical X'pert Pro X-ray Diffractometer using CuKα (λ=0.1542 nm) radiation. X-ray diffraction scans of the samples were carried out from 20 to 120 degrees 2Theta, with a step size of 0.006 degrees, and a dwell time of 60 seconds. After CuKα2 peak stripping and background subtraction, peaks were fit to Gaussian and Lorentzian profiles. The instrumental broadening was removed as a function of 2Theta using integral breadth. Crystallite size of the as-milled and heat treated samples were then estimated using the Scherrer formula.

While the milling process results in a fine dispersion of solute in the solvent, post-milling treatment can enhance the properties of the mixture. One specific way of redistributing the solute is by imparting it with sufficient mobility, while exposing it to elevated temperature via annealing for instance, in the range of about 300 to 800° C. after the milling process. More specifically, annealing promotes thermodynamic stability when in the as-milled state, the stabilizing solute, in the exemplary case Ta, does not occupy all of the available grain boundary sites or other higher defect states (e.g., interstitials, triple junctions, vacancies). Thus, annealing can be effectively used to separate, redistribute, and move the stabilizing solute to the grain boundaries for better stabilizing and allowing control over the microstructure.

At higher temperatures (e.g., above about 800° C.), separation can further be induced, resulting in formation of isolated atomic clusters or larger particulates, which, in some systems can lead to destabilization and rapid grain size coarsening. In general, annealing at a particular temperature can be used as the means to verify if a particular equilibrium grain size has been attained. That is, because using long term annealing (i.e., several hours at specific temperatures) can be used to discount the role of kinetic stability. Recall, kinetic stabilizers are in essence pinning agents dispersed to hold grain boundaries back from moving, coalescing, and growing.

Under ideal milling conditions, annealing may be unnecessary because solute solvent mixing can occur at the atomic level. However, if coarser solute clusters (e.g., having a size of about few tens of atoms) are desired or for some reasons a gradient structure is required wherein a specific part of the bulk needs to have fewer solute atom, annealing and reblending can achieve that. Reblending herein is defined as additional mixing of powdered mixtures.

Generally, annealing results in rapid coarsening. In most nanocrystalline systems, the majority of coarsening occurs in the first several seconds, however, to rule out more sluggish kinetically driven and dependent growth, as well as to promote particle bonding during densification much longer anneal times are required. The exemplary annealing range for the Cu-Ta alloyed composites, therefore, should be 1 second to 24 hours in length at a temperature between 300 to 800° C.

FIG. 1 shows x-ray diffraction patterns of the as-milled Cu-10 at. % Ta showing the presence of the Ta phase, and the diffraction pattern is given in. The alloy was milled for 10 hours at cryogenic temperatures.

X-ray diffraction (XRD) analysis of the as-milled alloy powder fabricated by high energy milling resulted in a nanostructured composite. This is evident in the extreme line broadening of the peaks. Grain size estimates were approximately 10 nm for both Cu and Ta. The ratio of peak heights gives an estimate of the type and relative amount of texturing, if any, is present. XRD patterns collected from powder samples should be void of texture. The peak width, or formally the full width at half maximum, is used to make estimates of the internal microstructural length scale using one of several known methods, (e.g., Scherrer, Warren-Averbach, Stokes-Wilson, or Williamson-Hull).

Figure 2:
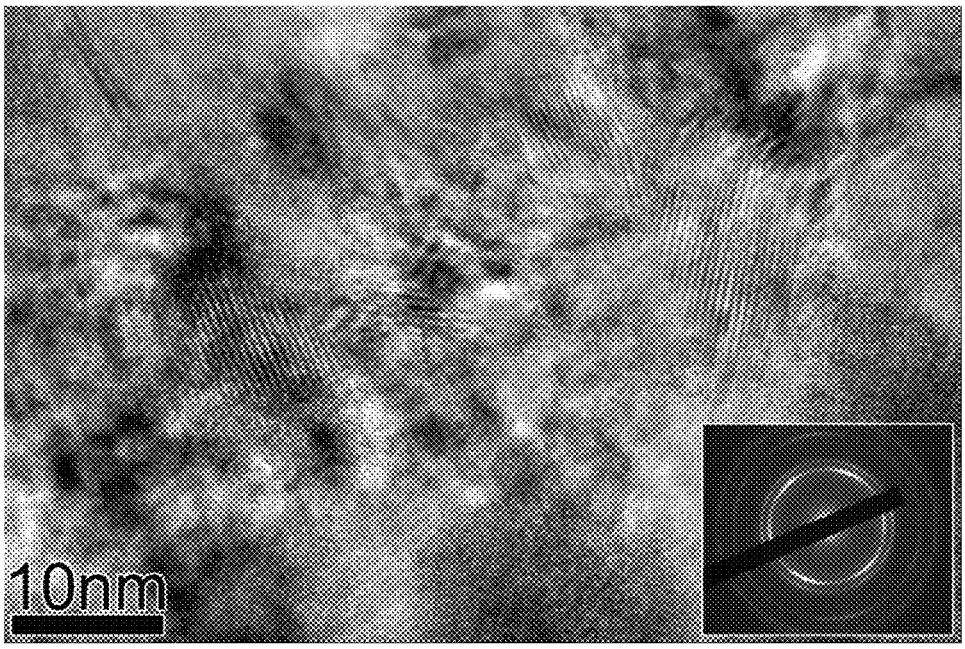
FIG. 2 is a transmission electron microscopy (TEM) image of the as-milled Cu-10 at. % Ta showing that the average grain size is approximately 10 nm.

FIG. 2 is a transmission electron microscopy (TEM) image of the as-milled Cu-10 at. % Ta showing that the average grain size is approximately 10 nm. Small tablets were made by uniaxially cold pressing the as-milled powder at 3.5 GPa in a 3-mm diameter WC die. These tablet samples, along with loose powders, were also subsequently annealed in a Netzsch 402E high temperature dilatometer for 4 hours at various temperatures under pure $H_2$ gas. The tablet-shaped compacts were used to make microhardness measurements and loose powder was used for the x-ray powder diffraction experiments. It is conceivable that compacts could have been used for x-ray as well, however, these were avoided, as strain, induced during pressing of the tablets, could have obscured the XRD grain size estimates.

Figure 3:
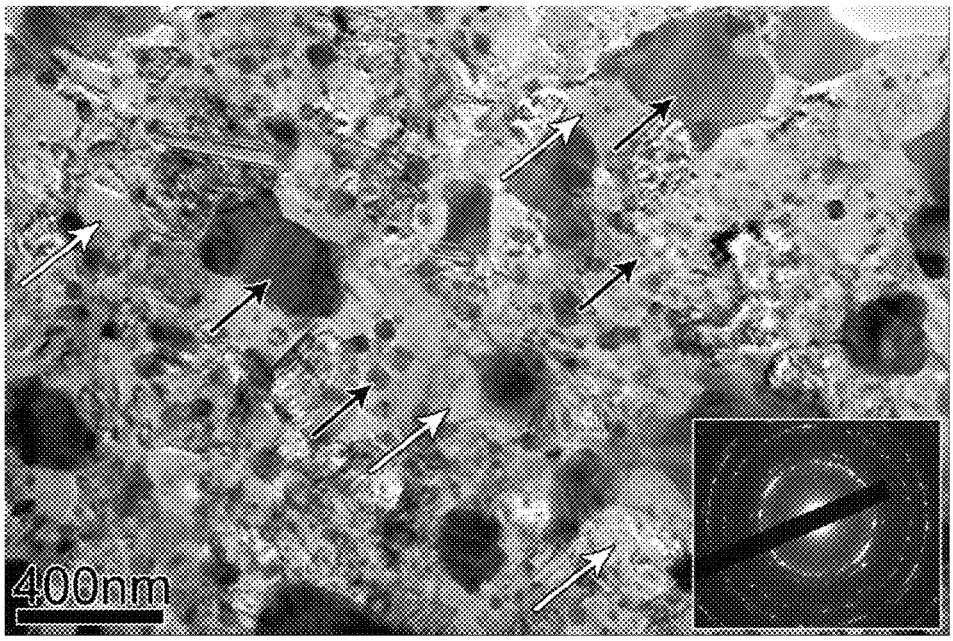
FIG. 3 is a TEM image of the microstructure of Cu-10 at. % Ta annealed at 1040° C. for 4 hours.

FIG. 3 illustrates a TEM image of the microstructure of the as-milled powder after annealing at 1040° C. for 4 hours, or 98.3% of the melting temperature of Cu. The microstructure is composed of a Cu matrix which retains an average grain size less than 200 nm (white arrows) after this heat treatment. And the homogenously dispersed Ta particles have an average grain size much less than 200 nm after this heat treatment. The Ta particle size ranges from 10 nm to 400 nm in diameter (black arrows), with an average particle size of about 75 nm.

Figure 4:
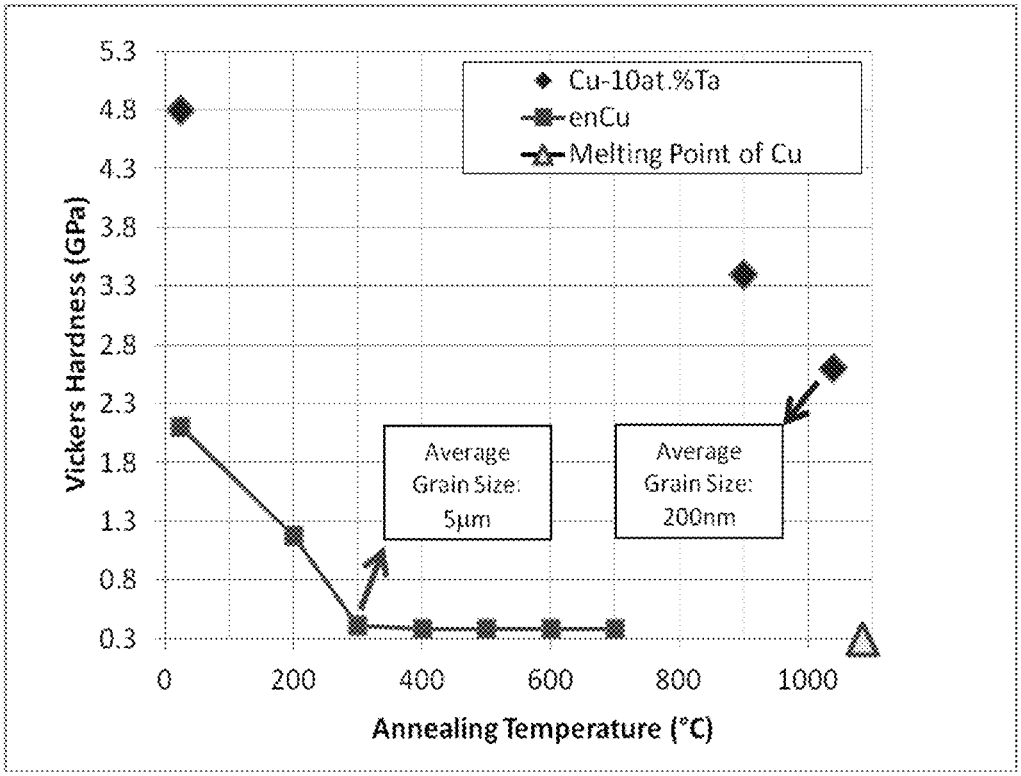
FIG. 4 shows a graph of Vickers microhardness versus annealing temperature for Cu-10 at. % Ta.

FIG. 4 shows a plot of the Vickers microhardness versus annealing temperature for the Cu-10 at. % Ta specimen compared to pure electroplated nanocrystalline copper (enCu). The microhardness correlates inversely with the grain size. As is apparent from the plot, despite a slight decrease in hardness of the the Cu-10 at. % Ta specimen as the annealing temperature rises, the microhardness of Cu-10 at. % Ta remains considerably higher than that of the Cu throughout the temperature range up to the melting point temperature of Cu.

It is believed that the electroplated nanocrystalline Cu undergoes rapid grain growth to the micrometer-scale at a very low temperature of 300° C. In contrast, the Cu-10 at. % Ta alloy according to embodiments of the present invention retains the stable nanograined structure up to 1040° C.

In this example, the Ta:Cu ratio was maintained at 1:9. However, the number of components is not necessarily limited to two, solute species (in addition to Ta), determined by the overall application, could be selected to meet a variety of different functions. However, under the best-case scenario, the solute species are not to interact with one another.

Conversely, it is noted that limited or extensive interaction (repulsive or attractive) between the solutes could also be utilized for specific purposes. Unlike a single, highly insoluble solute species that would precipitate out of solution at certain sites when an appropriate temperature is reached, the respective chemical and physical properties (i.e., electronegativity, chemical and ionization potential, oxidation state, electrical resistivity, polarizability, metallic or covalent radius, melting point, crystal structure, etc.) of multiple solutes can be used to augment or accentuate the resultant alloy properties. For example, these may include co-precipitation of pure metal or intermetallics with a sub- to nanostructure at preferred grain boundary sites. Alternatively, the creation of patterned or textured structures on a macro-, micro-, meso-, or nanoscale could yield selective properties, unlike those found in the pure parent metal or an alloy with random distribution of a single or dual precipitate species.

Regardless, in the Cu-Ta alloy system, it is expected that the relative ratio of the components will have a direct effect on the volume fraction of dispersed Ta phase and the overall grain boundary segregated solute concentration. These two key parameters govern the overall thermal stability of the sample and equilibrium grain size achieved for a given annealing temperature. While it is expected that some of the fabrication conditions may be adjusted to accommodate a diminished or an excess of solute concentration, there is a breadth of flexibility afforded by the methodology described in this invention.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present disclosure and its practical applications, and to describe the actual partial implementation in the laboratory of the system which was assembled using a combination of existing equipment and equipment that could be readily obtained by the inventors, to thereby enable others skilled in the art to best utilize the invention and various embodiments with various modifications as may be suited to the particular use contemplated.

While the foregoing is directed to embodiments of the present invention, other and further embodiments of the invention may be devised without departing from the basic scope thereof, and the scope thereof is determined by the claims that follow.

The invention claimed is:

1. A process for forming a binary or higher order thermodynamically stable nanostructured copper-tantalum metallic system comprised of a solvent of copper (Cu) metal comprising 70 to 99.9 atomic percent (at. %) of the metallic system, and a solute of tantalum (Ta) metal dispersed in the solvent metal, comprising 0.1 to 30 at. % of the metallic system, the process comprising:

subjecting powder metals of the solvent metal and the solute metal to a milling process using a milling device configured to shake the powder metals with ball media in a generally back and forth direction at least 1060 times per minute to impart impacts to its contents to produce the metallic system having an average grain size of no more than approximately 10 nm, wherein the metallic system is thermally stabilized, with the absence of substantial gross grain growth, such that the internal grain size of the solvent metal is substantially suppressed to no more than about 250 nm at approximately 98% of the melting point temperature of the solvent metal and the solute metal remains substantially uniformly dispersed in the solvent metal at that temperature.

2. The process of claim 1, wherein the milling device used to subject the metallic powder to the milling process utilizes:

a mixing vial for containing the metallic powders; and a plurality of milling balls comprising the ball media for inclusion within the mixing vial for milling the metallic powders therein.

3. The process of claim 2, wherein the ball-to-powder mass ratio utilized by the milling device is 10:1 or more.

4. The process of claim 2, wherein the milling balls are comprised only of stainless steel.

5. The process of claim 1, further comprising:

cooling the metallic powders, during the milling process, to a cryogenic temperature.

6. The process of claim 5, wherein the milling device is cooled with liquid nitrogen.

7. The process of claim 1, further comprising:

mixing an additive or a surfactant with the metallic powders and ball media during the milling process.

8. The process of claim 7, wherein the additive or a surfactant is not a liquid at room temperature.

9. The process of claim 1, wherein the milling process is performed at ambient or room temperature.

10. The process of claim 1, wherein the metallic powders are continuously or semi-continuously cooled during the milling process.

11. The process of claim 1, further comprising:

exposing the metallic powders to elevated temperature in the range of about 300 to 800° C. after the milling process.

12. The process of claim 1, comprising performing said milling so as to produce the metallic system having a Vickers microhardness of about 3.00 GPa or more at room temperature.

13. The process of claim 1, wherein the milling device is a shaker mill.

14. The process of claim 1, wherein the milling results in at least 2120 impacts a minute.

15. A process for forming a binary or higher order thermodynamically stable nanostructured copper-tantalum metallic system comprised of a solvent of copper (Cu) metal comprising 85 to 99.99 atomic percent (at. %) of the metallic system, and a solute of tantalum (Ta) metal dispersed in the solvent metal, comprising 0.01 to 15 at. % of the metallic system, the process comprising:

subjecting powder metals of the solvent metal and the solute metal to a milling process using a milling device configured to shake the powder metals with ball media in a generally back and forth direction at least 1060 times per minute to impart impacts to its contents to produce the metallic system having an average grain size of no more than approximately 10 nm, wherein the metallic system is thermally stabilized, with the absence of substantial gross grain growth, such that the internal grain size of the solvent metal is substantially suppressed to no more than about 250 nm at approximately 98% of the melting point temperature of the solvent metal and the solute metal remains substantially uniformly dispersed in the solvent metal at that temperature.

* * * * *